US012245654B2

(12) United States Patent
Sholev

(10) Patent No.: US 12,245,654 B2
(45) Date of Patent: Mar. 11, 2025

(54) FOLDABLE HELMET

(71) Applicant: Mordehai Sholev, Amikam (IL)

(72) Inventor: Mordehai Sholev, Amikam (IL)

( * ) Notice: Subject to any disclaimer, the term of this patent is extended or adjusted under 35 U.S.C. 154(b) by 0 days.

(21) Appl. No.: 18/567,987

(22) PCT Filed: Jun. 8, 2022

(86) PCT No.: PCT/IL2022/050608
§ 371 (c)(1),
(2) Date: Dec. 7, 2023

(87) PCT Pub. No.: WO2022/259250
PCT Pub. Date: Dec. 15, 2022

(65) Prior Publication Data

US 2024/0260703 A1 Aug. 8, 2024

Related U.S. Application Data

(60) Provisional application No. 63/208,057, filed on Jun. 8, 2021.

(51) Int. Cl.
*A42B 3/22* (2006.01)
*A42B 3/32* (2006.01)

(52) U.S. Cl.
CPC ..... *A42B 3/322* (2013.01); *A42B 3/227* (2013.01)

(58) Field of Classification Search
CPC ..... A42B 3/322; A42B 3/324; A42B 3/32
USPC ..... 2/410
See application file for complete search history.

(56) References Cited

U.S. PATENT DOCUMENTS

| | | | | |
|---|---|---|---|---|
| 7,958,572 | B2 * | 6/2011 | Loury | A42B 3/322 2/420 |
| 9,554,611 | B2 * | 1/2017 | Arrouart | A42B 3/322 |
| 2009/0222976 | A1 * | 9/2009 | Loury | A42B 3/322 2/421 |
| 2012/0216338 | A1 * | 8/2012 | Arrouart | A42B 3/322 2/410 |
| 2024/0260703 | A1 * | 8/2024 | Sholev | A42B 3/322 |

FOREIGN PATENT DOCUMENTS

| | | | |
|---|---|---|---|
| JP | 2016204803 | A | 12/2016 |
| JP | 2019073823 | A | 5/2019 |
| KR | 102099555 | B1 | 4/2020 |
| KR | 102142990 | B1 | 8/2020 |
| WO | 2022259250 | A1 | 12/2022 |

OTHER PUBLICATIONS

PCT International Search Report for International Application No. PCT/IL2022/050608, mailed Sep. 13, 2022, 3pp.
PCT Written Opinion for International Application No. PCT/IL2022/050608, mailed Sep. 13, 2022, 5pp.

* cited by examiner

*Primary Examiner* — Gloria M Hale
(74) *Attorney, Agent, or Firm* — The Roy Gross Law Firm, LLC; Roy Gross

(57) ABSTRACT

A foldable helmet is provided. The helmet includes a plurality of struts hingedly interconnected thereby enabling the struts to splay out from a closed packed state. Each strut includes a hinge along a length of the strut for folding the strut and a plurality of cutouts allowing the strut to bow in a direction opposite a fold direction of the hinge.

20 Claims, 28 Drawing Sheets

FOLDABLE HELMET

CROSS REFERENCE TO RELATED APPLICATIONS

This application is a National Phase of PCT Patent Application No. PCT/IL2022/050608 having International filing date of Jun. 8, 2022, which claims the benefit of priority of U.S. Provisional Patent Application No. 63/208,057, filed Jun. 8, 2021, the contents of which are all incorporated herein by reference in their entirety.

BACKGROUND

The present invention relates to a foldable helmet. Embodiments of the present invention relate to a foldable bicycle helmet that can be folded into a pocketable volume.

The use of helmets greatly increases the chances of a cyclist surviving a crash, however, many commuters who walk part of the journey and cycle part of the journey do not use helmets since they can be bulky and thus difficult to stow, uncomfortable to carry or both.

The foldable bicycle helmet was designed to tackle the issues of portability while providing the necessary safety to commuters.

Although several foldable designs are commercially available none provide an acceptable tradeoff between portability and safety. In addition, even the most portable designs are still bulky.

There is thus a need for, and it would be highly advantageous to have, a foldable helmet that provides the necessary safety and yet has a form factor, when folded, that enables stowing in small bags and even pockets.

SUMMARY

According to one aspect of the present invention there is provided a foldable helmet comprising a plurality of struts being hingedly interconnected thereby enabling the struts to splay out from a closed packed state, wherein each strut includes at least one additional hinge along a length of the strut for folding the strut; and a plurality of cutouts allowing the strut to bow in a direction opposite a fold direction of the at least one additional hinge.

According to still further features in the described preferred embodiments splaying out the plurality of struts bows the struts.

According to still further features in the described preferred embodiments splaying and bowing of the struts locks the helmet in a usable shape.

According to still further features in the described preferred embodiments end portions of each of the plurality of struts are prism or triangular-shaped.

According to still further features in the described preferred embodiments front and/or back end portions of the plurality of struts interlock when the plurality of struts are splayed open.

According to still further features in the described preferred embodiments the foldable helmet further comprises a chin strap.

According to still further features in the described preferred embodiments the helmet is a flat rectangle in the closed packed state.

According to still further features in the described preferred embodiments the chin strap includes two portions attached to struts of the plurality of struts.

According to still further features in the described preferred embodiments pulling on the two portions of the chin strap splays out the plurality of struts and opens the helmet.

According to still further features in the described preferred embodiments the foldable helmet further comprises a foldable visor attached to a front ends of the plurality of struts.

According to still further features in the described preferred embodiments the struts end portions include a locking mechanism such as a tongue in groove.

Unless otherwise defined, all technical and scientific terms used herein have the same meaning as commonly understood by one of ordinary skill in the art to which this invention belongs. Although methods and materials similar or equivalent to those described herein can be used in the practice or testing of the present invention, suitable methods and materials are described below. In case of conflict, the patent specification, including definitions, will control. In addition, the materials, methods, and examples are illustrative only and not intended to be limiting.

BRIEF DESCRIPTION OF THE DRAWINGS

The invention is herein described, by way of example only, with reference to the accompanying drawings. With specific reference now to the drawings in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the Drawings.

DETAILED DESCRIPTION

Figure 1A:
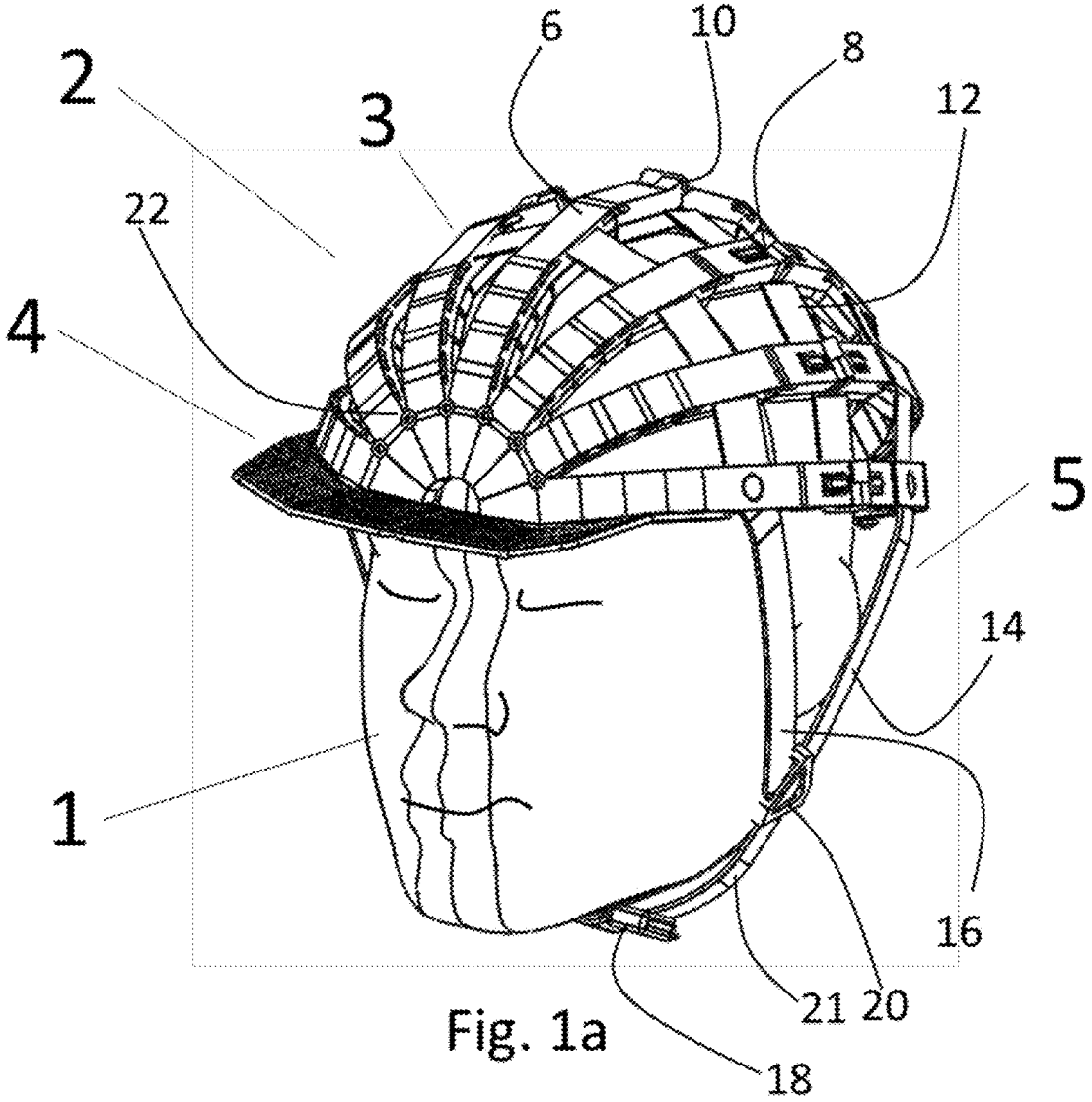
FIGS. 1*a-c* illustrate the helmet in an open state worn on the head of a user and in a closed stowable state.

The present invention is of a foldable helmet which can be used by commuters.

The principles and operation of the present invention may be better understood with reference to the drawings and accompanying descriptions.

Before explaining at least one embodiment of the invention in detail, it is to be understood that the invention is not limited in its application to the details of construction and the arrangement of the components set forth in the following description or illustrated in the drawings. The invention is capable of other embodiments or of being practiced or carried out in various ways. Also, it is to be understood that the phraseology and terminology employed herein is for the purpose of description and should not be regarded as limiting.

It is well known that helmets can substantially reduce the severity of head injuries in crashes. In the case of commuters riding bicycles that share the streets with motor vehicles, high impact crashes are commonplace as well as head injuries that result from riding a bicycle without a helmet. While cyclists are aware of the benefits of helmets, many do not use them since they are bulky to carry or stow when off the bicycle.

The present invention comprises a foldable helmet configuration that is compact enough, when in the folded state, to enable stowage in small bags or even in a pocket. As is further described hereinbelow, the design of the present helmet utilizes a unique combination of flexible struts and hinges that enables rapid and easy transition from a compact folded state to an open helmet-like shape.

Thus, according to one aspect of the present invention, there is provided a foldable helmet. As used herein, the term "helmet" refers to any protective headgear that can be worn by cyclists, individuals on scooters or any personal transportation device, motorized or not. The present helmet can also be adapted for use in high-risk environments that require protective headgear (e.g., construction) as well as any sport activity where the size and compactness of a helmet is important, The helmet of the present invention includes a plurality of struts being hingedly interconnected, with hinges at the ends of the struts (end hinges), thereby enabling the struts to splay out from a closed packed state. Each strut comprises an additional hinge along its length (mid hinge) and a plurality of cutouts that enable the strut to bow in a direction opposite to that of folding through the mid hinge.

When the helmet is in a closed state, the struts are positioned side by side and in contact with one another and form a largely flat rectangle. The rectangle can be folded lengthwise through the mid hinge to form the packed state (slightly thicker yet smaller rectangle).

The cutouts on inner surface of each strut allow the strut to bow and form a helmet shape when the struts are splayed out to the open position.

Splaying out the struts to open the helmet serves two purposes, it bows the struts to create the dome shape of the helmet and also locks the struts and mid hinge thereby preventing collapse of the helmet shape. Each strut includes a triangular/prism-shaped end that locks into an adjacent strut end (via a tongue and groove or the like) when the struts are fully splayed out (fully opened)

The helmet can comprise a strap, preferably a strap having two portions lockable under the chin, although a one-piece strap lockable under the ear is also possible. The two portions of the two-piece strap are attached to struts (e.g., the outermost struts) and can be used to open the helmet by simply resting the closed (yet non-packed) helmet on the head and pulling the strap portions downward. The helmet can also comprise a visor integral or attachable to the helmet.

Referring now to the drawings, FIGS. 1-10 illustrate an embodiment of the present helmet, which is referred to herein as helmet 2.

Figure 1B:
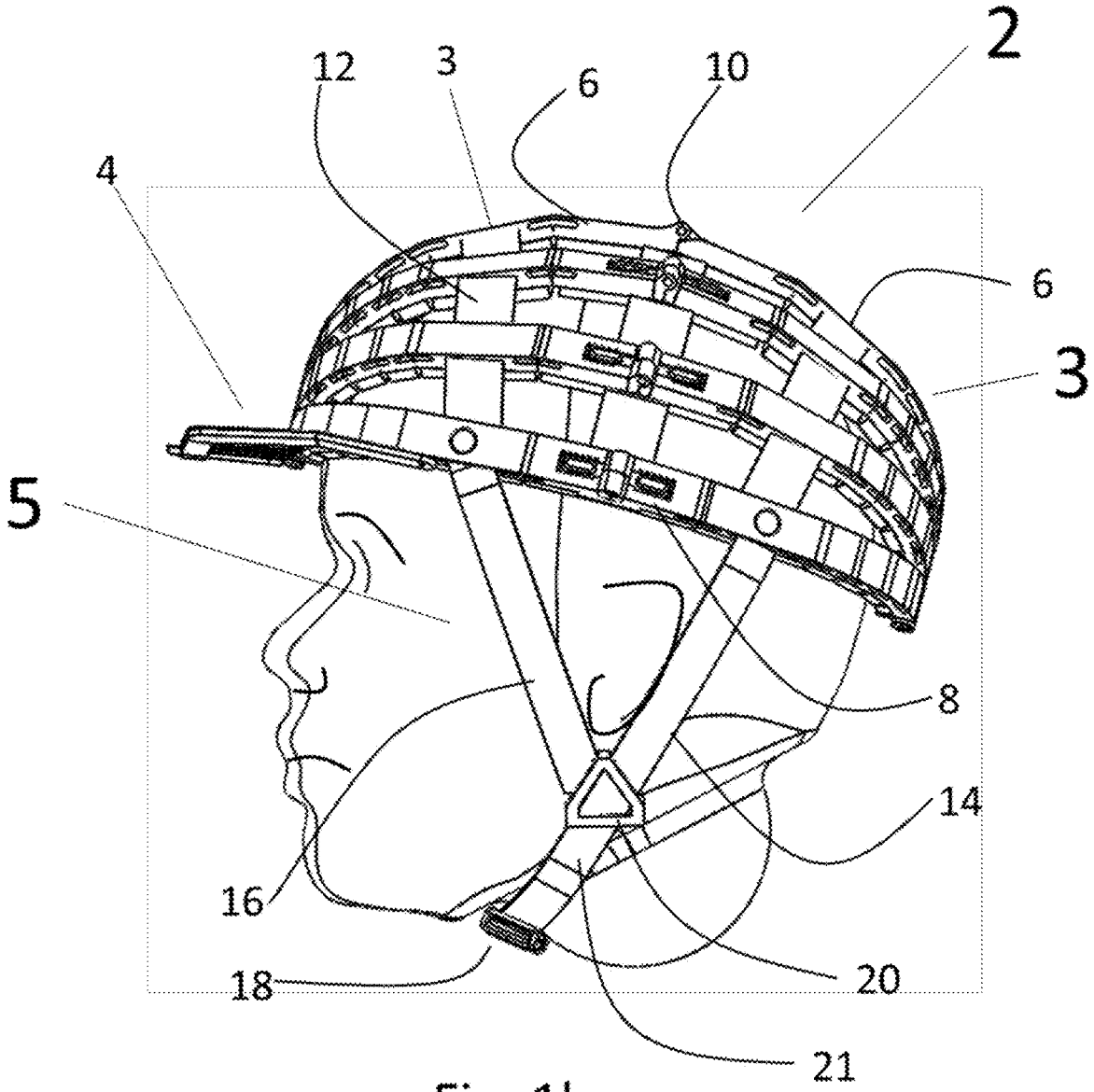
Figure 1C:
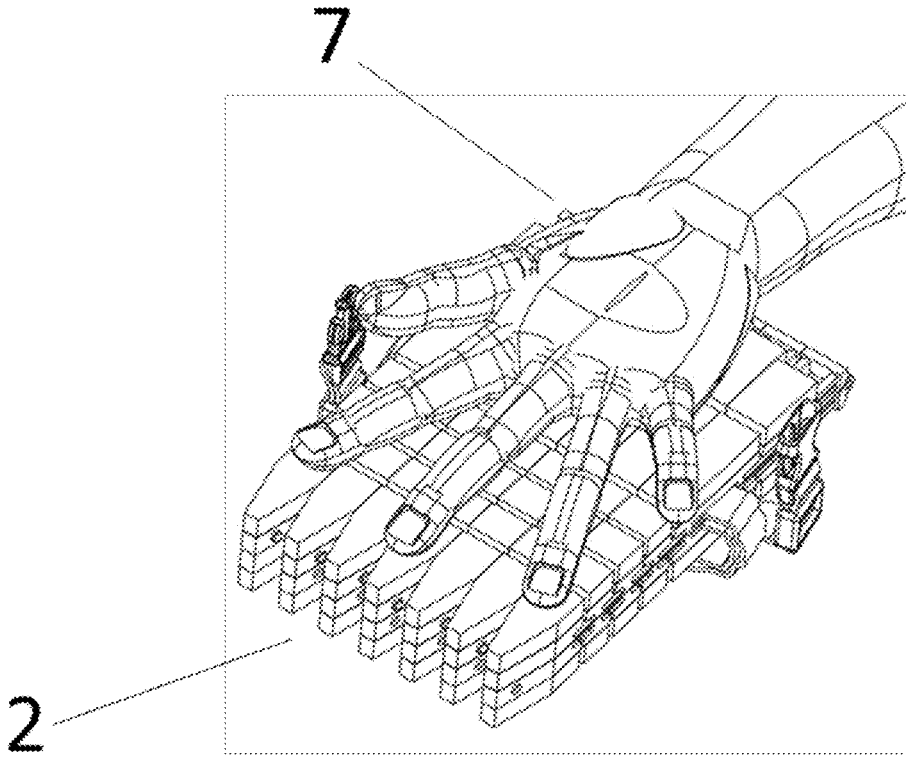

FIG. 1*a-c* illustrates an embodiment of the present helmet, with FIG. 1*a* showing a perspective view of the helmet on a user, FIG. 1*b* showing a helmet on a user from the side, and FIG. 1*c* showing the helmet in a folded configuration. FIG. 1*a-b* shows user 1 wearing helmet 2, visor 4 is a part of helmet 2 and is foldable therewith as is described in more detail hereinbelow. Strap system 5 is used to secure helmet 2 to a head of user 1. Strap system 5 includes front strap 16, back strap 14, chin strap 21 and a quick release buckle 18. Connector 20 is used to adjust straps 14 and 16.

Helmet 2 includes longitudinal struts 3 formed from two elements 6 connected via hinge 10. transverse bands 12 pass through slits in each of element 6. In the configuration shown in FIG. 1, helmet 2 includes seven struts 3 however, any number of struts can be used, e.g., 3, 4, 5, 6, 8, 9, 10 etc. Ratchet mechanism 8 enables precise adjustment of a length of each strut 3 to enable a precise fit to the head of an individual.

Element 6 may be composed of, for example, polyurethane, polyamide, or polypropylene. A typical length of element 6 can be 140 mm±20 mm and a typical width of element 6 may be 20 mm±10 mm. The slit can be oval in shape with a length of 8 mm±4 mm and a diameter of 2 mm±1 mm, with a bending force of 1-2 Newtons (N). Each strut 3 is connected to an adjacent strut 3 via hinge 22.

FIG. 1*c* is shows the helmet 2 in its folded state. In its folded state the elements of helmet are arranged in small box configuration having a size not bigger than a hand 7 of the user.

Figure 2A:
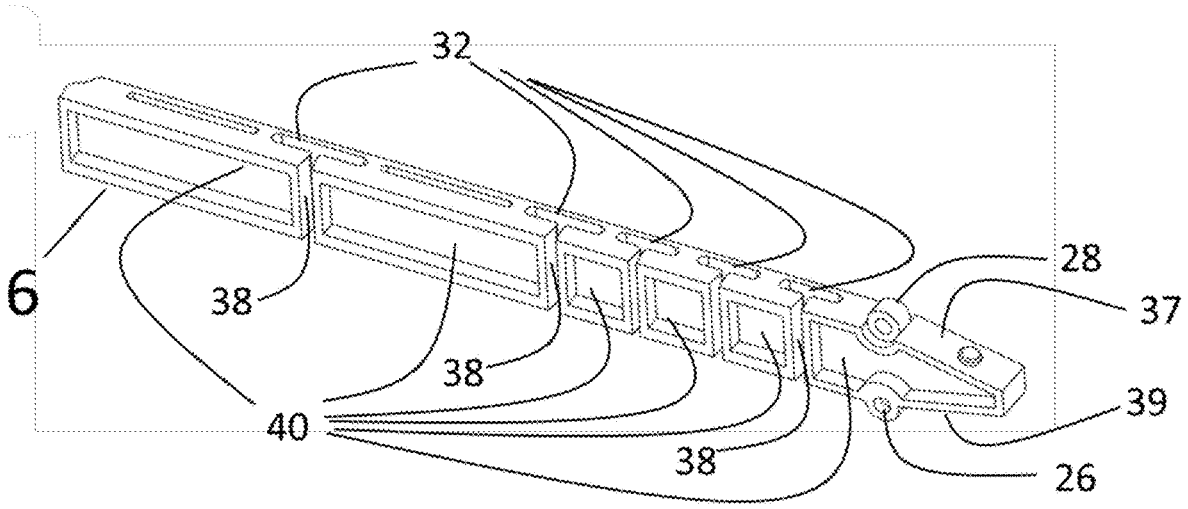
FIGS. 2*a-f* illustrate the flexible struts of one embodiment of the present helmet.
Figure 2B:
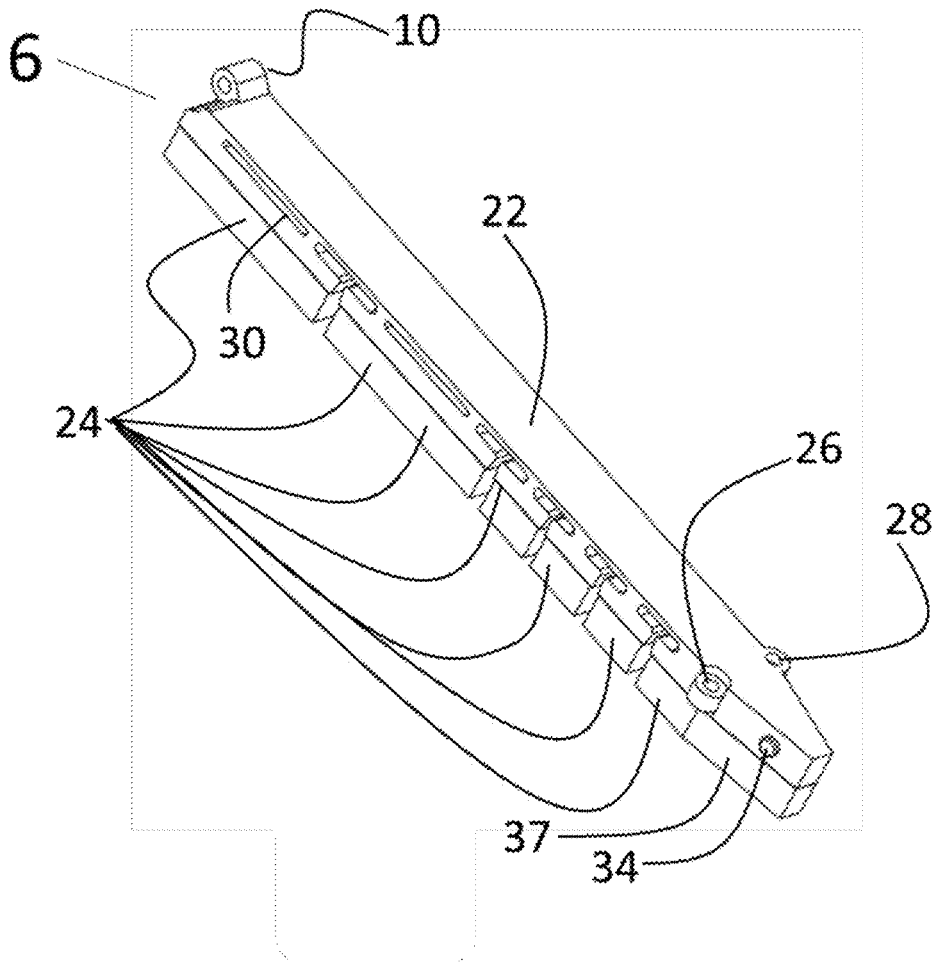
Figure 2C:
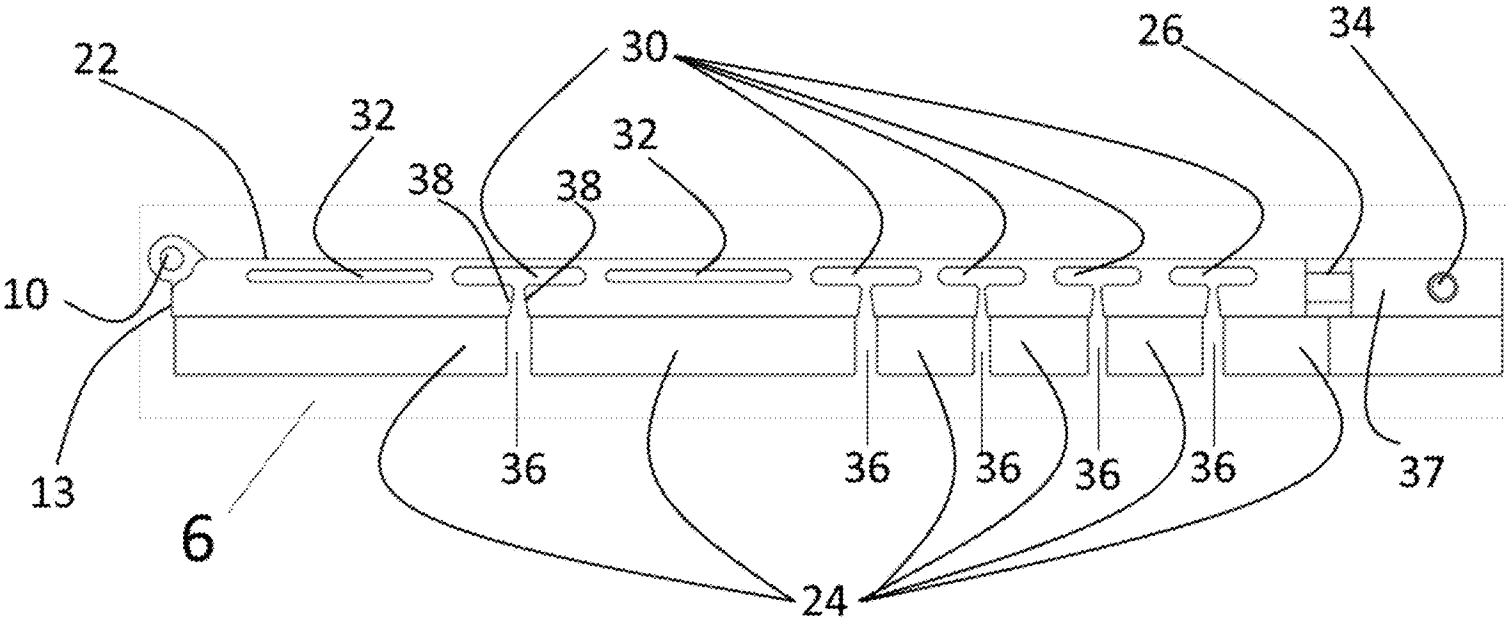

FIGS. 2*a-c* illustrate element 6 in a straight state. Element 6 is comprised of a rigid yet elastic body 22 having oval slits 30 with oblique openings 36 forming cutouts in the underside (head-facing side) of each element. Slits 30 and oblique opening 36 enable the bending of element 6 to a stable and rigid arc shape as is described later. Oval slits 30 are used for passing transverse straps through body 22. Impact-absorbing pads 24 are placed in compartments 40 enabling firm attachment, in both normal and side directions, to rigid body 22. A wall 38 of each compartment 40 forms one side of oblique opening 36. Hinge 10 is located in the proximal end of bendable element 6, while hinge portions 26 and 28 are located at the distal end of bendable element 6. Each distal end of body 22 has oblique walls 37 and 39.

Each of the absorbing pads 24 may have different shape and size and may be made of different materials from the other pads, enabling optimal design of each region of helmet to absorb different forces and impacts.

Figure 2D:
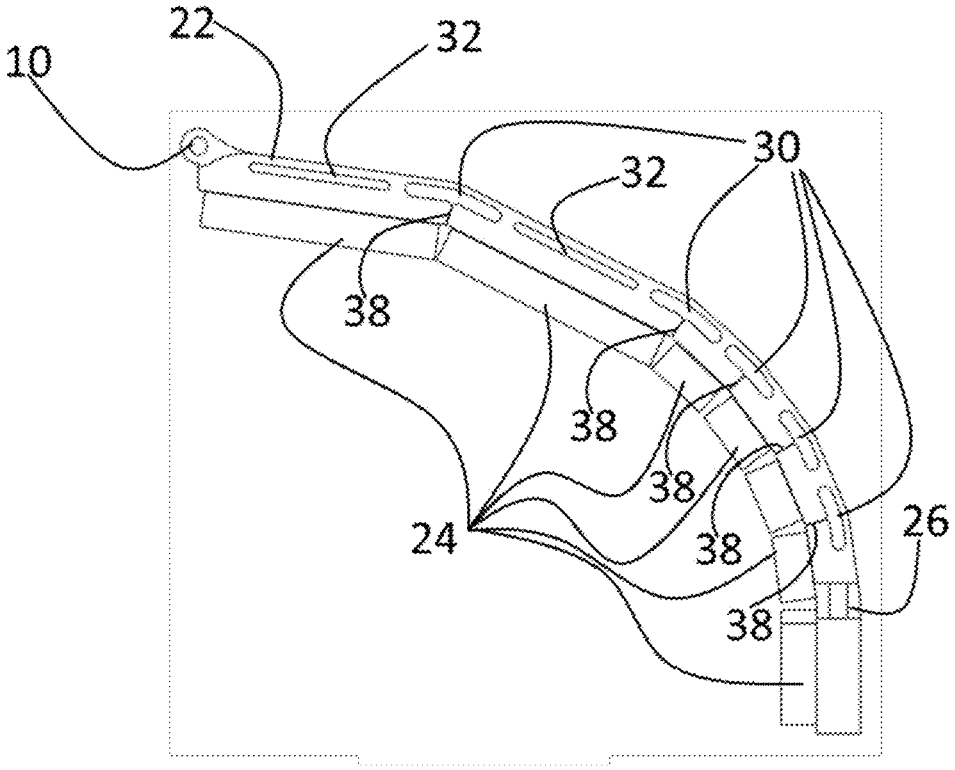

FIG. 2*d* illustrates a single bendable element 6 in a bent (bowed) state. The design of slits 30 (see FIG. 2*b-c*) and oblique openings 36 (see FIG. 2*c*) causes walls 38 of each compartment 40 to touch and support each other resulting a self-locking bowed structure (arc).

Figure 2E:
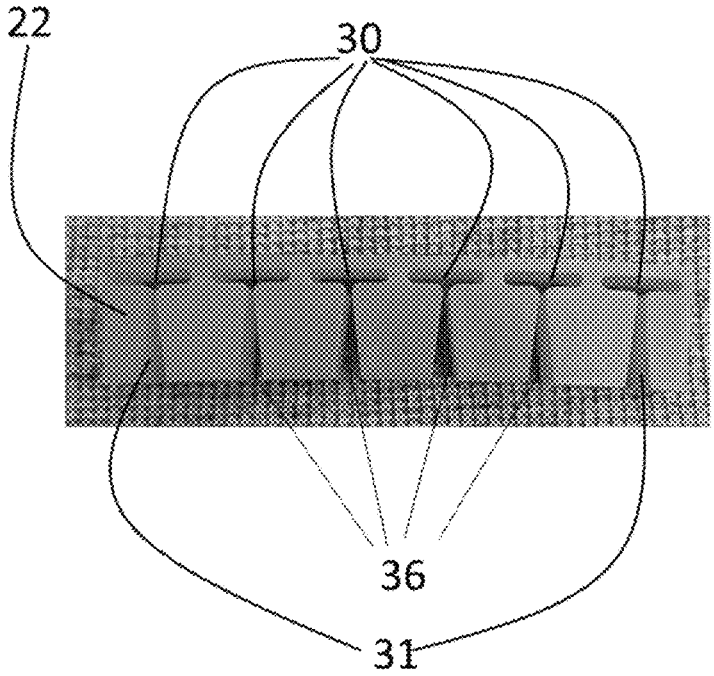
Figure 2F:
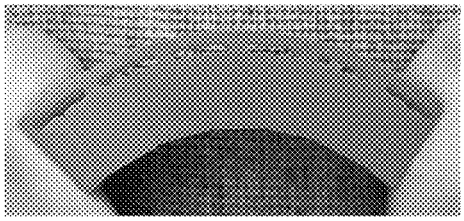

FIG. 2*e* is a side view of a single 3D printed bendable element having the same structure of body 22 described in FIGS. 2*a-*2*d*. in this example walls 31 of each compartment 40 may be seen. FIG. 2*f* is a side view of the bendable element presented in FIG. 2*e* in bent state.

Figure 3A:
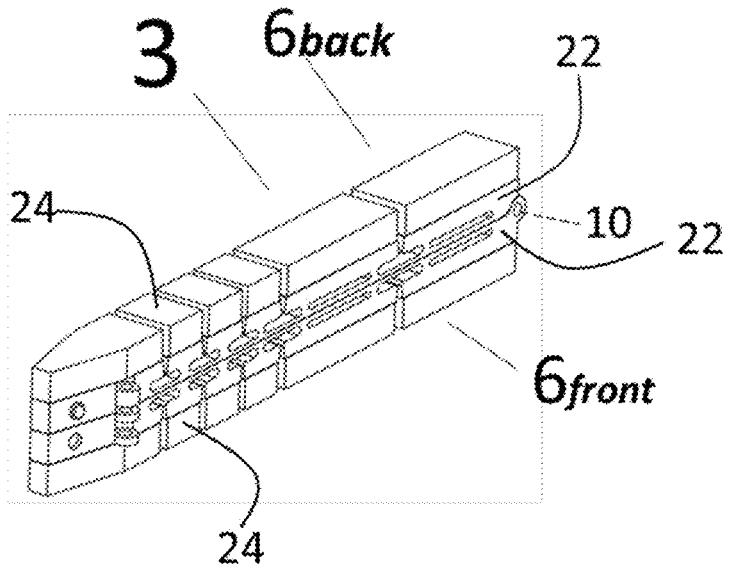
FIGS. 3*a-c* illustrate the unfolding mechanism of a single strut of one embodiment of the present helmet.

FIGS. 3*a-*3*c* illustrate a strut 3 in a folded configuration (FIG. 3*a*), an unfolded configuration (FIG. 3*b*) and the bowed configuration (FIG. 3*c*) that results from splaying of the struts 3. As described hereinabove, each strut is formed from two hinged elements 6 (referred to as "front element 6" and "back element 6"). The elements 6 have bodies 22 and absorbing pads 24.

In order to unfold strut 3 from the folded state shown in FIG. 3*a*, back element 6 is rotated around hinge 10, until back surfaces 13 (shown in FIG. 4*b*) of elements 6 contact. Bowing of strut 3 to achieve the arc shown in FIG. 3*c* occurs when struts 3 are splayed out.

Figure 3B:
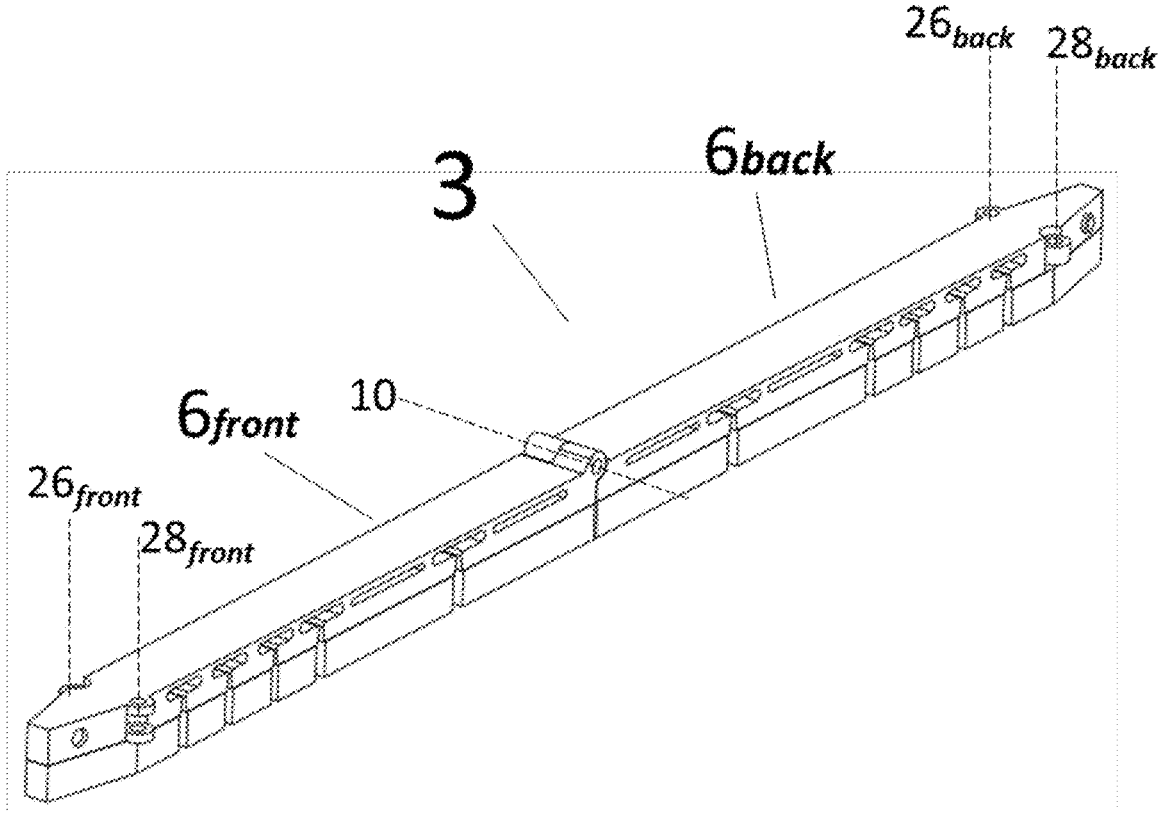
Figure 3C:
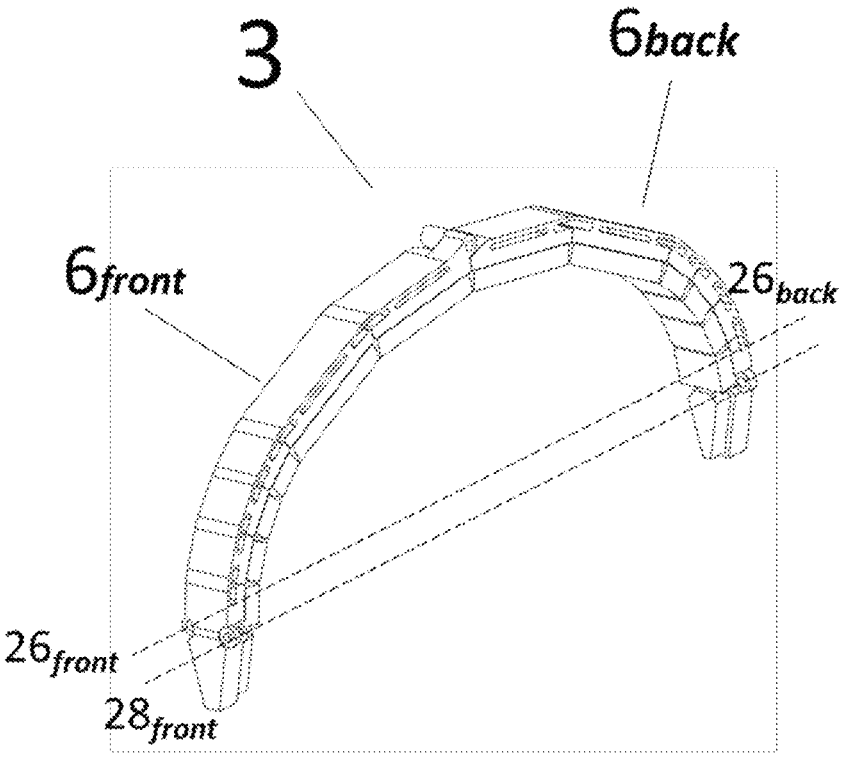

FIGS. 3*b*-3*c* show the hinge portions $\mathbf{26}_{front}$, $\mathbf{26}_{back}$, $\mathbf{28}_{front}$ and $\mathbf{28}_{back}$ that connect a strut 3 to adjacent struts 3. Each hinge portion 26 on one strut 3 is interconnected to a hinge portion 28 on an adjacent strut 3. Each pair of interconnected hinge portions 26 and 28 forms a hinge 128 that allows hinging between adjacent struts 3; there are therefore two hinges joining each pair of adjacent struts 3, a front hinge $\mathbf{128}_{front}$ comprising hinge portions $\mathbf{26}_{front}$ and $\mathbf{28}_{front}$, and a back hinge $\mathbf{128}_{back}$ comprising $\mathbf{26}_{back}$ and $\mathbf{28}_{back}$.

Figure 4A:
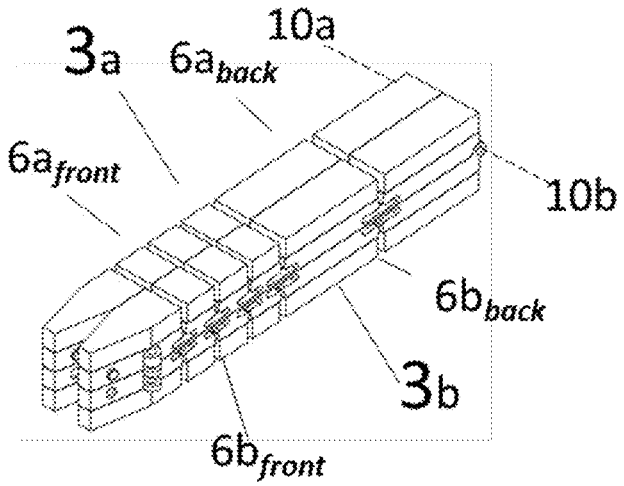
FIGS. 4*a-d* illustrate the unfolding and opening mechanisms of two struts of one embodiment of the present helmet.
Figure 4B:
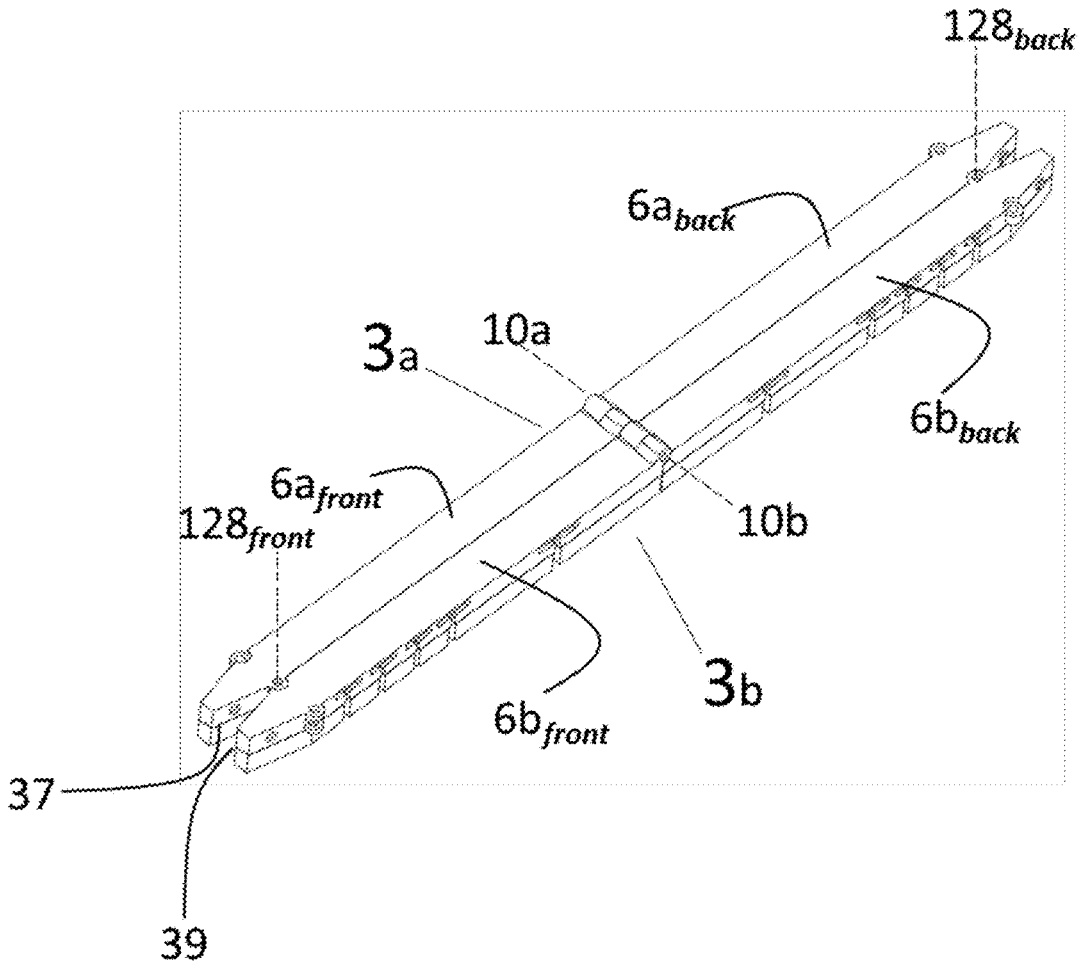

FIGS. 4*a*-*d* illustrate unfolding of a pair of struts 3*a* and 3*b*. Struts 3*a* and 3*b* are interconnected via 2 hinges: hinge $\mathbf{128}_{front}$ and hinge $\mathbf{128}_{back}$. Hinges 10*a* and 10*b* (mid hinges) are concentric (but not interconnected). In order to unfold struts 3*a* and 3*b*, element $\mathbf{6}a_{back}$ and $\mathbf{6}b_{back}$ are both rotated around hinges 10*a* and 10*b*, until back surfaces of elements 6 contact each other (FIG. 4*b*). While hinges 10*a* and 10*b* maintain their concentric position through unfolding, the axis of hinges $\mathbf{128}_{front}$ and $\mathbf{128}_{back}$ are now parallel, and the hinges reside on opposite sides of unfolded struts 3*a* and 3*b*.

Figure 4C:
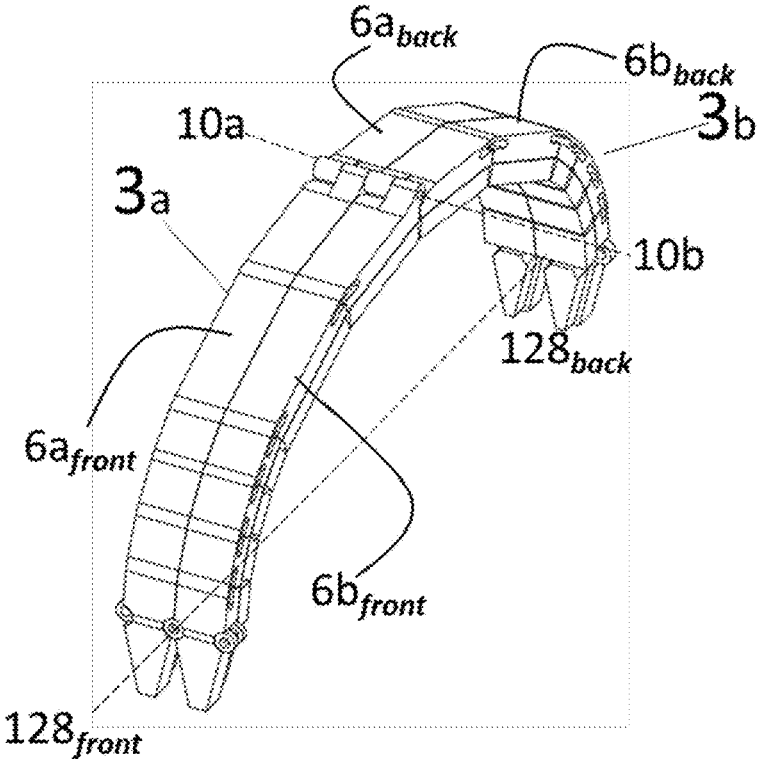

FIG. 4*c* illustrates struts 3*a* and 3*b* in the unfolded and bowed state; hinges 10*a* and 10*b* maintain their concentric position and interconnected hinge portions $\mathbf{28}_{front}$ and $\mathbf{28}_{back}$ are now again concentric.

Figure 4D:
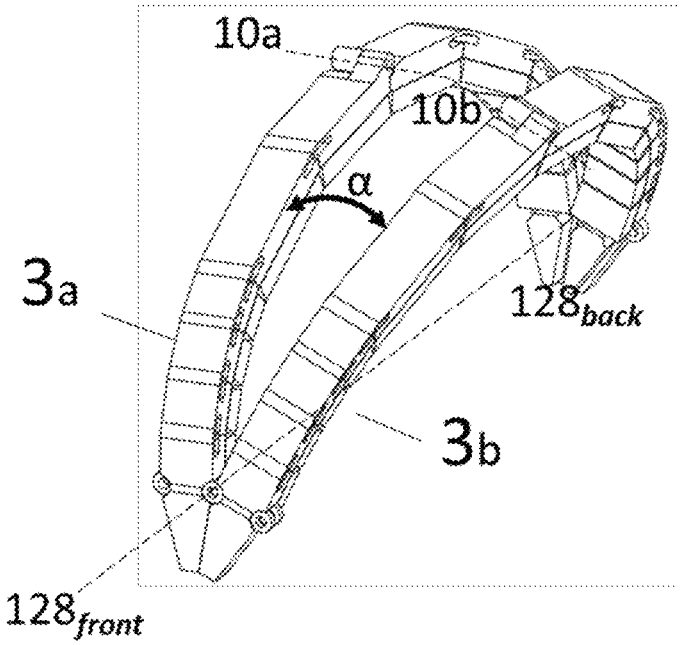

FIG. 4*d* illustrates splaying of struts 3*a* and 3*b* as they rotate around interconnected hinge portions $\mathbf{28}_{front}$ and $\mathbf{28}_{back}$ until oblique frontal walls 37 and 39 of bodies 22 make contact. determining angle α. When struts 3 are in the splayed position shown in FIG. 4*d*, hinge $\mathbf{28}_{front}$ and hinge $\mathbf{28}_{back}$ are concentric, while hinge 10*a* and hinge 10*b* are not concentric.

The unfolding mechanism described in FIGS. 4*a*-*d* may be applied to any number of longitudinal struts. Any desired size and the shape of a helmet may be achieved by changing the geometrical properties of body 22, the number of struts 3 and the properties (density, shape) of absorbing pads 24.

FIGS. 5*a*-*i* illustrate use of helmet 2 and the transition from a packed configuration to a usable configuration (half dome with visor). In this embodiment, helmet 2 includes 7 longitudinal struts 3.

Figure 5A:
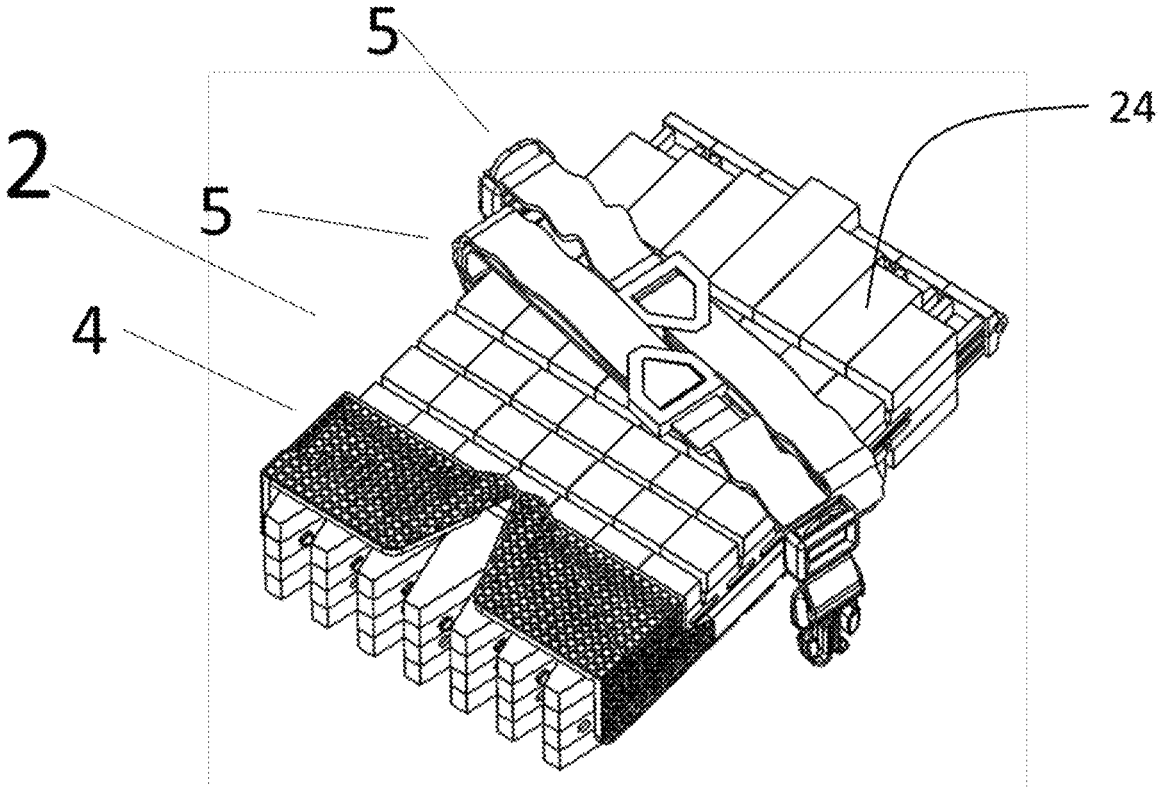
FIGS. 5*a-g* illustrate unfolding and wearing of one embodiment of the present helmet using a strap pulling opening mechanism.

FIG. 5*a* illustrates helmet 2 in the packed configuration. Visor 4 is in its folded state and serves to lock this rectangular configuration. The straps $\mathbf{5}_{left}$ and $\mathbf{5}_{right}$ are shown; the absorbing pads 24 are on the outside in the packed configuration. The parts of the quick release buckle 18 can be seen, attached to the chin strap 21.

Figure 5B:
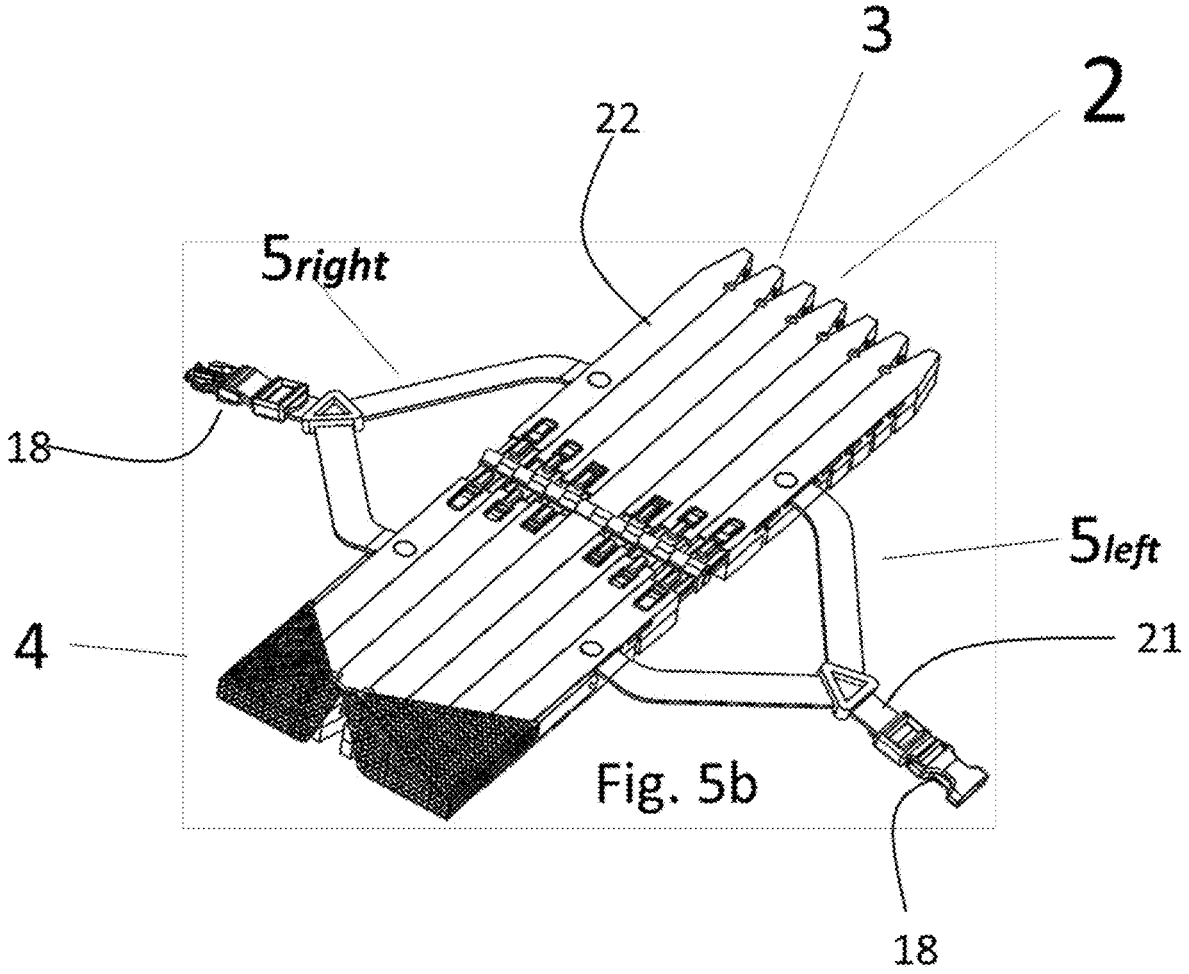
Figure 5C:
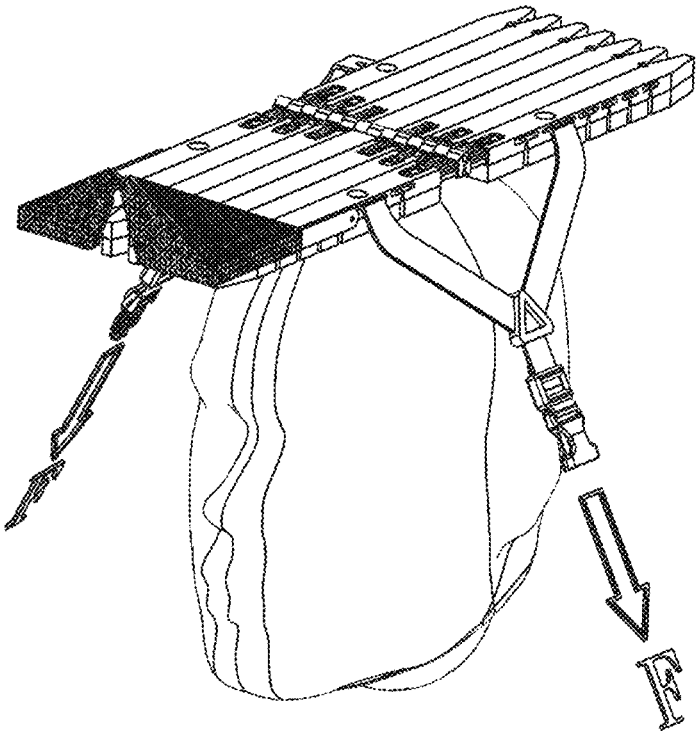
Figure 5D:
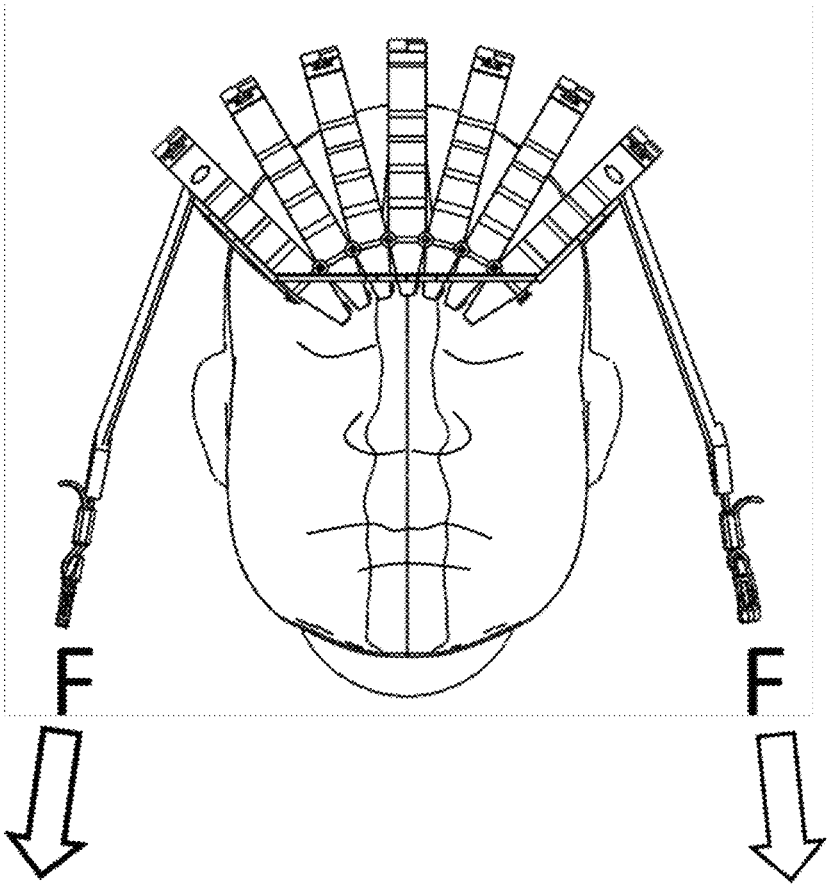
Figure 5E:
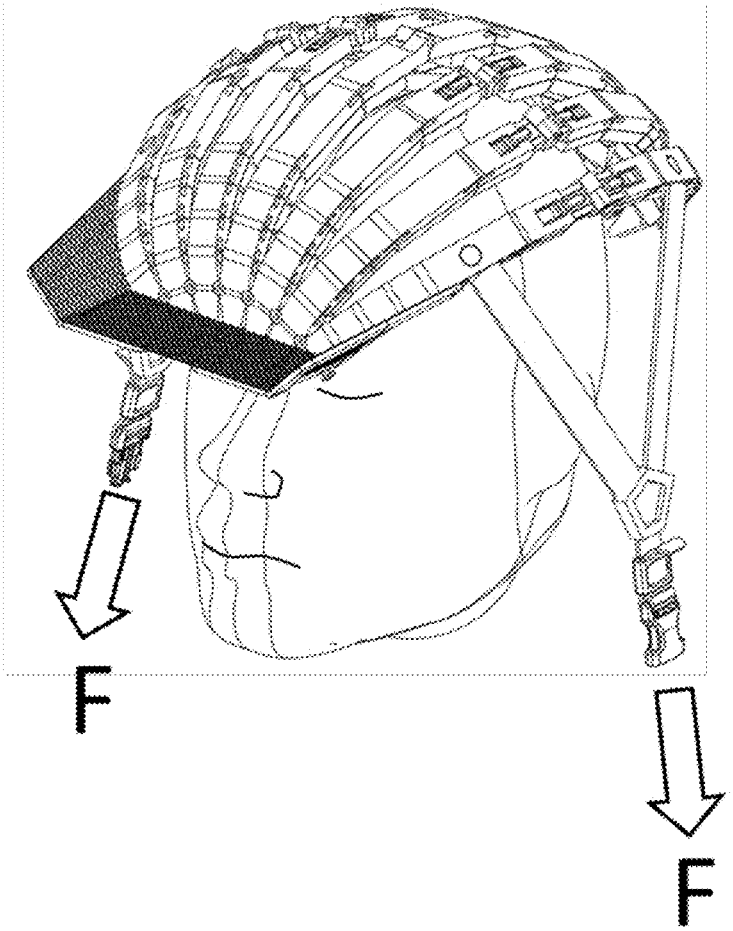

FIG. 5*b* illustrates helmet 2 in a flat unfolded configuration (also referred to herein as closed but not packed), struts 3 are open and flat. Visor 4 is unfolded but still holds the struts 3 together and the straps $\mathbf{5}_{left}$ and $\mathbf{5}_{right}$ are no longer wrapped around the struts 3. The FIGS. 5*c*-*g*, illustrate the transition from the flat closed state to the half dome fully open state (helmet state). Opening can be effected while user 1 'wears' the flat unfolded configuration and pulls the strap ends down (pulling force designated as 'F').

Figure 5F:
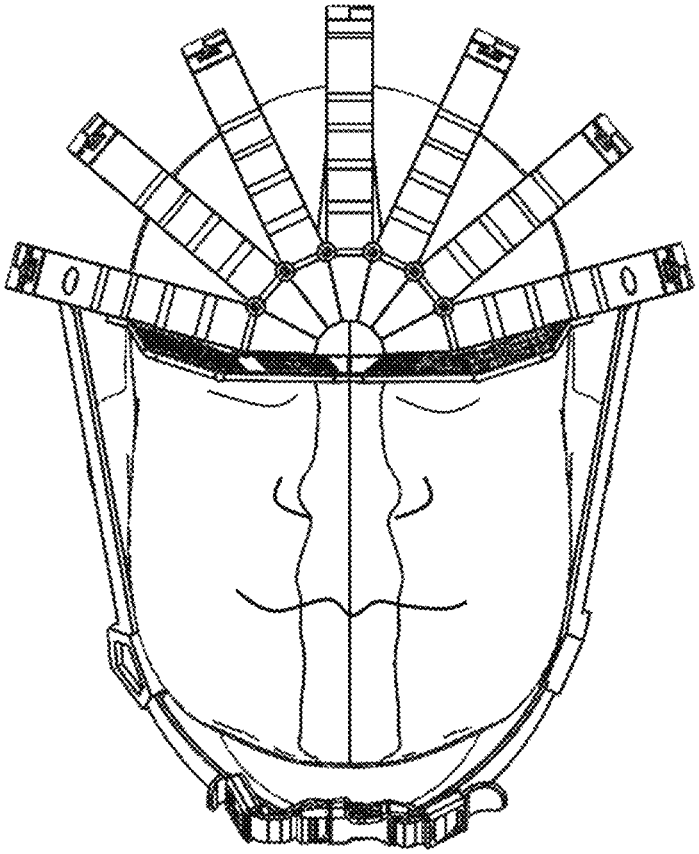
Figure 5G:
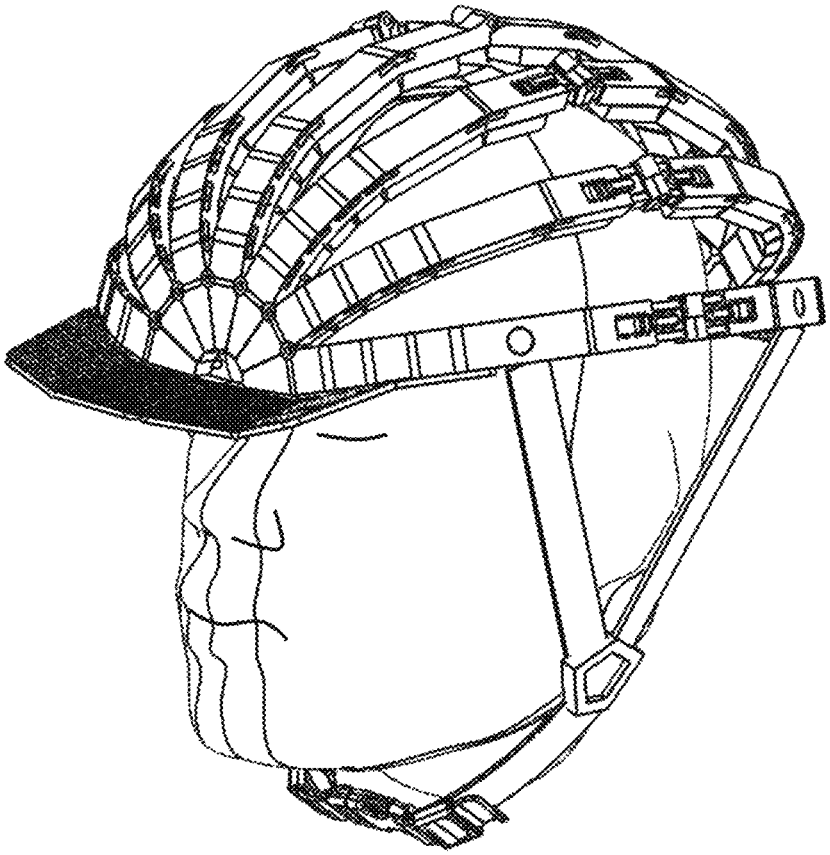

A pulling force of 1 N or more splays and bows struts 3 to achieve the dome shape shown in FIG. 5*f*-*g*.

Figure 6A:
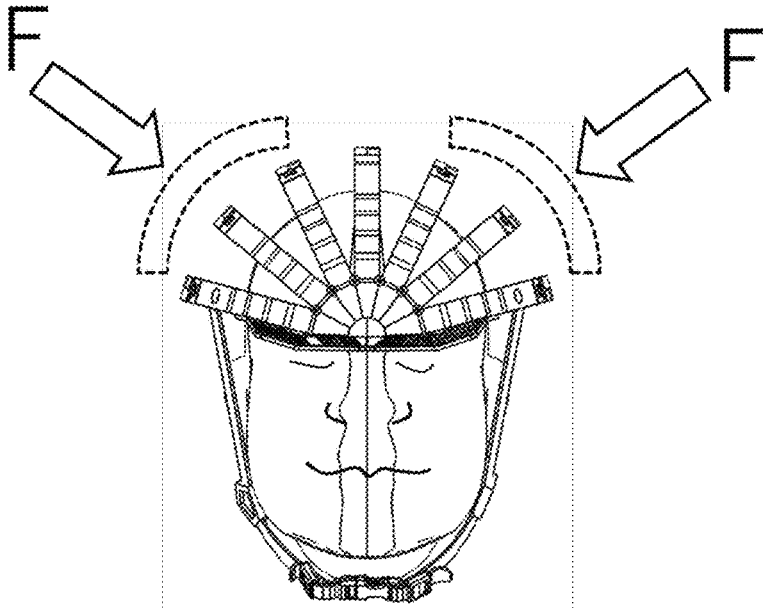
FIGS. 6*a-b* illustrate a size adjusting feature of one embodiment of the present helmet.
Figure 6B:
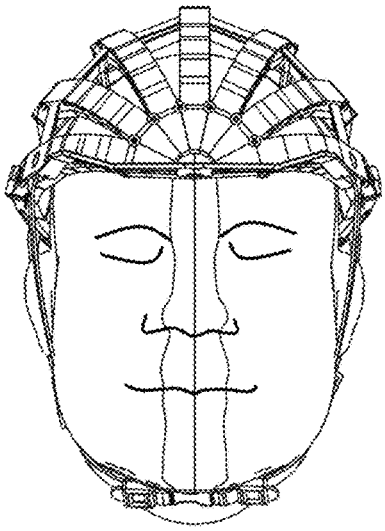
Figure 7A:
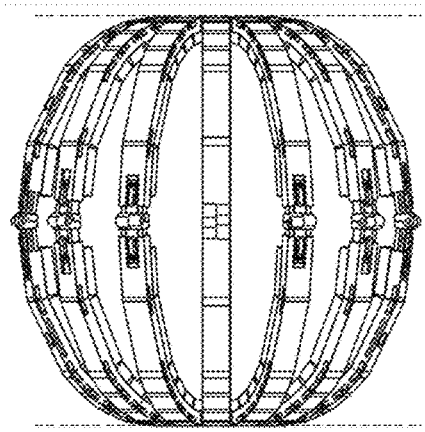
FIGS. 7*a-b* illustrate different sizes of one embodiment of the present helmet.
Figure 7B:
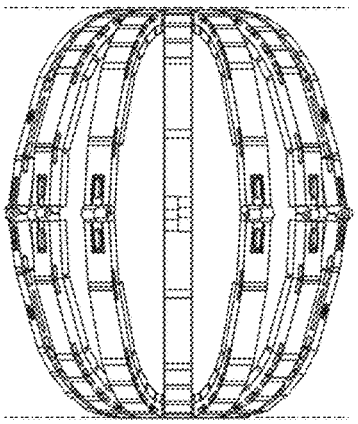

A size adjusting mechanism of helmet 2 is shown in FIGS. 6*a*-*b*. Once helmet 2 is fully opened, user 2 can apply a force F of 2N or more to each side of the helmet. The adjusting mechanism is formed into each strut 3 as is described in more detail below with reference to FIGS. 8*a*-8*e*. FIGS. 7*a* and 7*b* illustrate the different available sizes of helmet 2.

FIGS. 8*a*-*d* illustrate an embodiment of folding and size adjustment mechanisms of helmet 2. In order to enable size adjustment, each end hinge of element 6 (hinge 10) is connected to element 6 via a longitudinally adjustable ratchet mechanism.

Figure 8A:
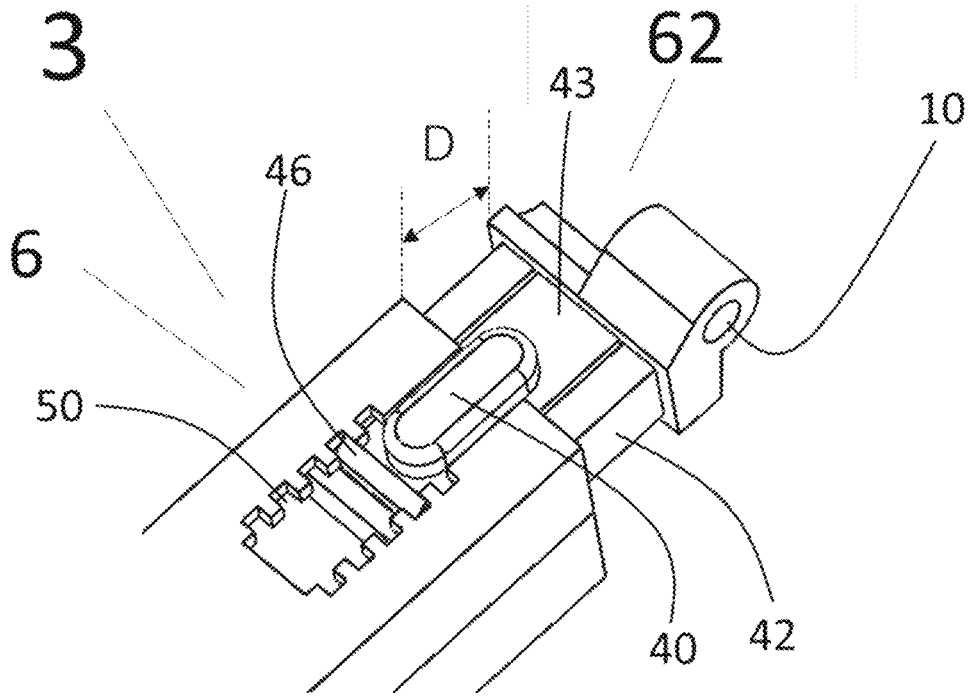
FIGS. 8*a-d* illustrate the folding and size adjusting mechanisms of one embodiment of the present helmet.
Figure 8B:
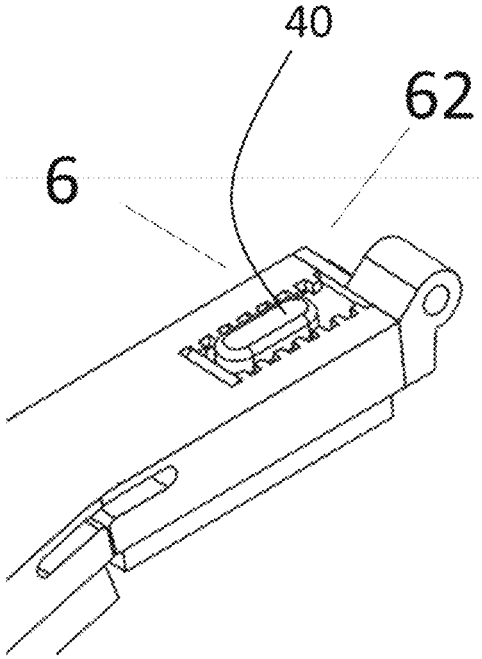

FIG. 8*a* is a perspective view of the length changing mechanism of strut 3 showing hinge part 62 extended away from element 6 by distance D. Body 42 of part 62 is supported by a cavity having tooth-shaped opening 50. Tab 46 of part 62 can be moved by the user by pressing down knob 40. FIG. 8*b* is a view of the sliding mechanism fully inserted into element 6.

Figure 8C:
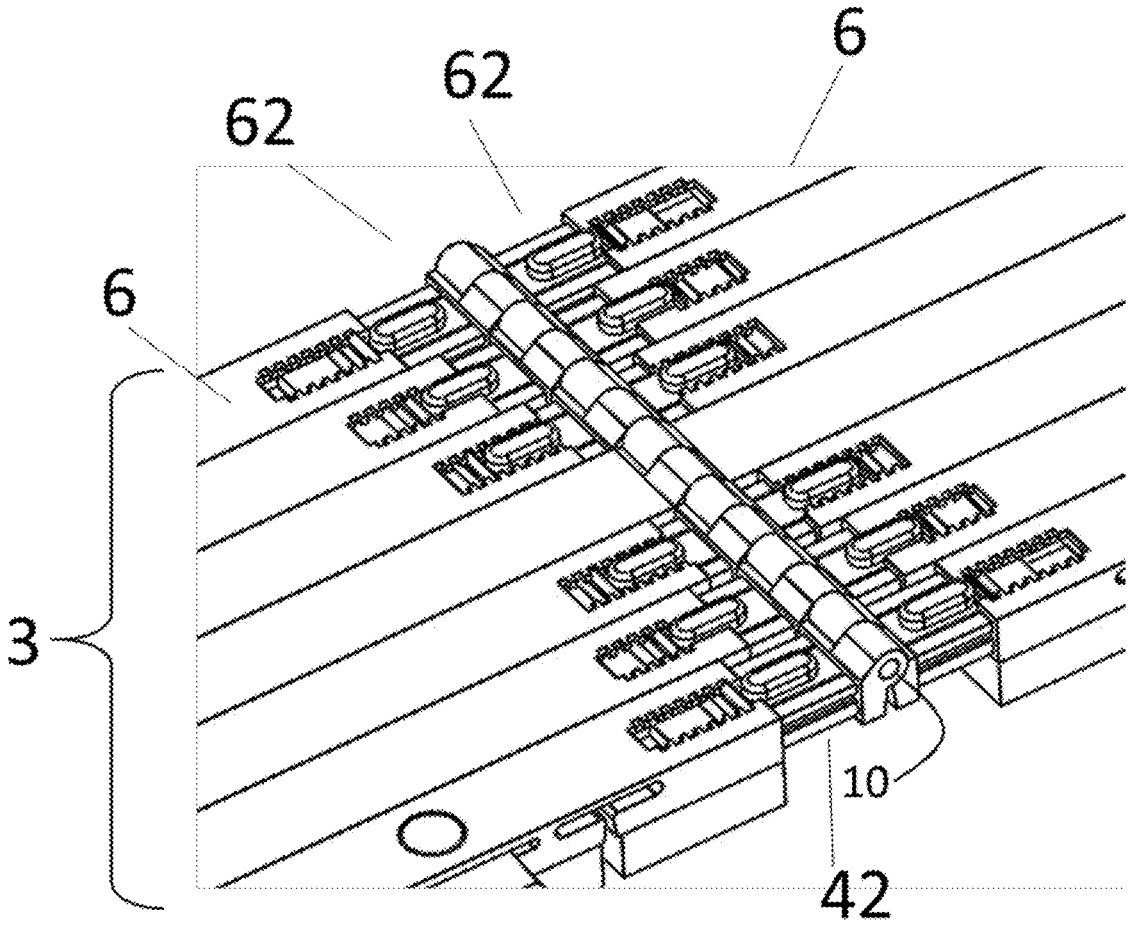

FIG. 8*c* is top view of flat unfolded helmet 2, presenting the middle section of struts 3 with elements 6, showing that each strut 3 has a different length adjustment, with, in this embodiment, the central strut 3 having no length adjustment and the outermost struts 3 having the largest length adjustment. It should be noted that the elements 6 of each strut 3 are connected by separate concentric hinges 10, the hinges 10 integral to part 62 with bodies 42.

Figure 8D:
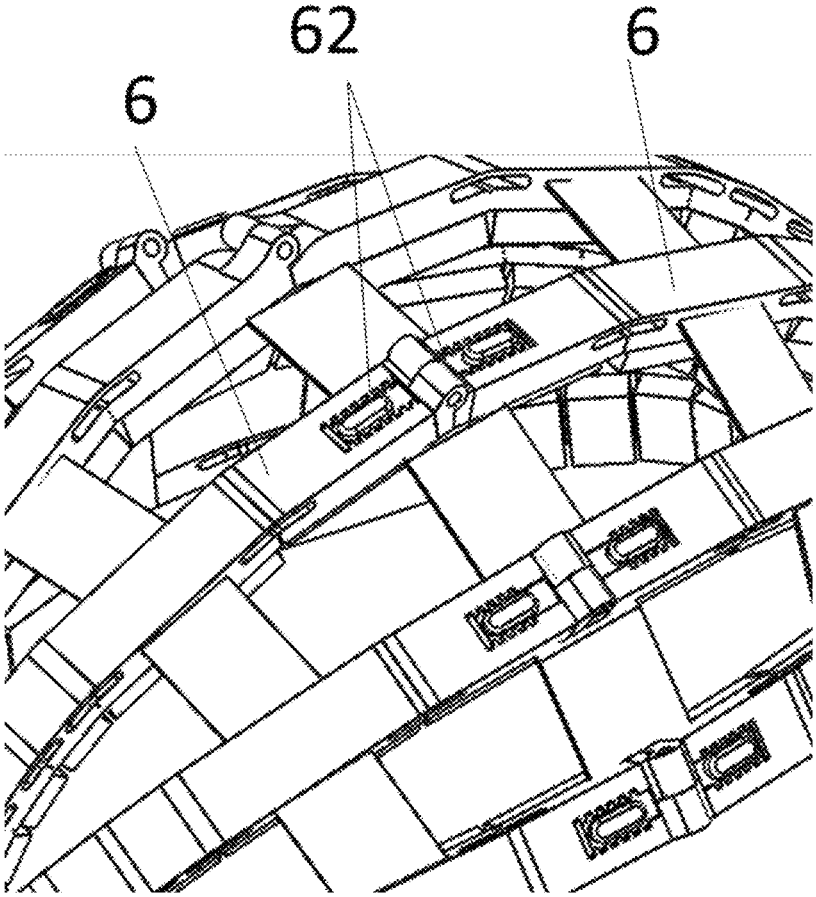

FIG. 8*d* illustrates the size adjusting mechanism described above as presented to the user on an open helmet 2. Since the ratchet mechanism (hinge part 62) flanks the mid hinge 10 linking elements 6, length adjustment does not move adjacent hinges 10 out of concentric alignment. (i.e., adjustment is made around the hinge point).

Figure 9A:
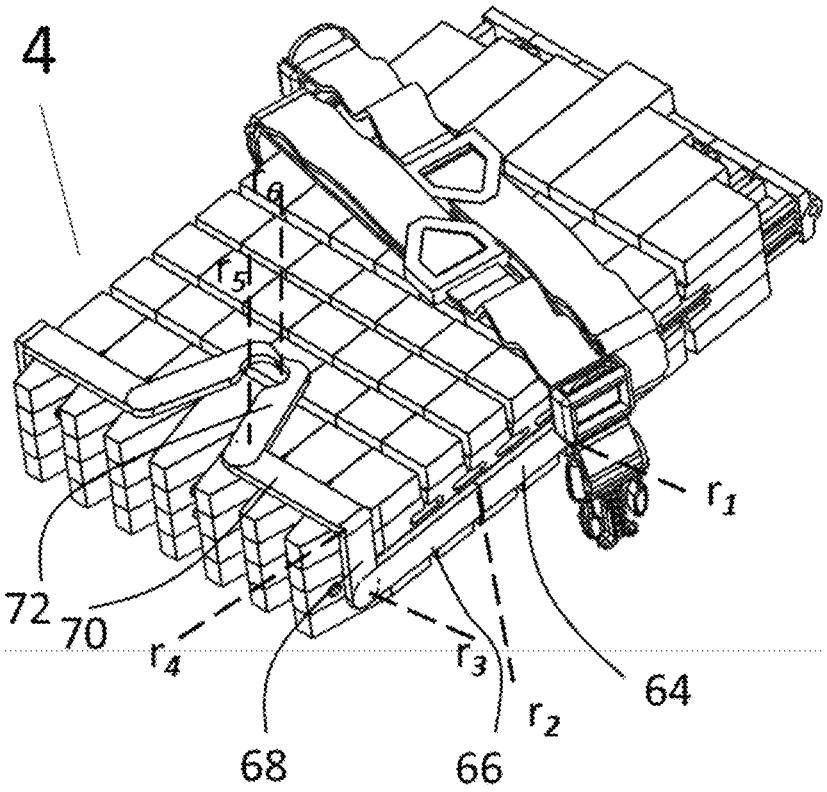
FIGS. 9*a-c* illustrate the structure of a visor that can be used with one embodiment of the present helmet.
Figure 9B:
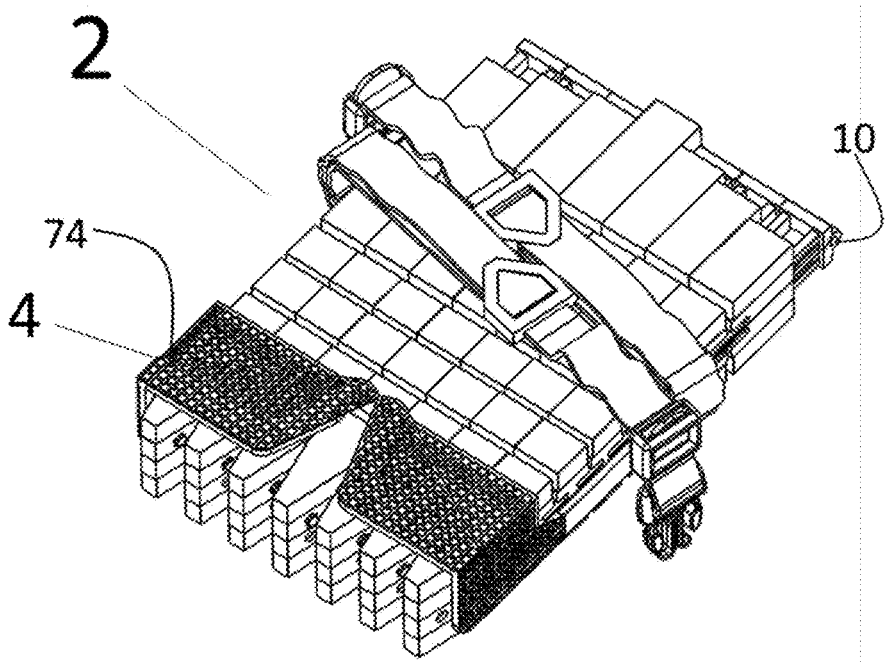
Figure 9C:
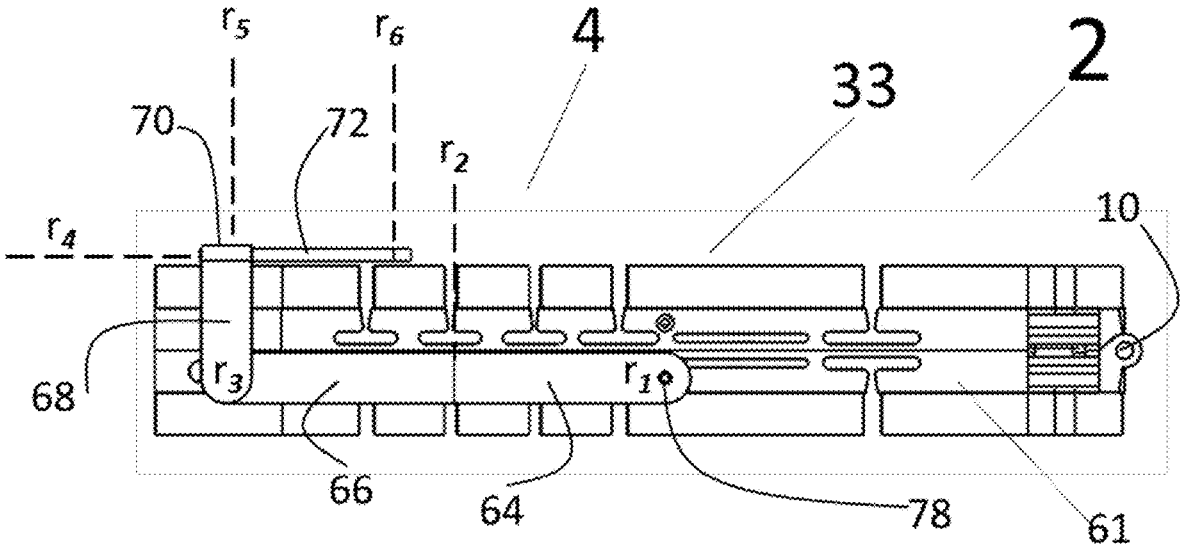

FIGS. 9*a*-*c* illustrate schematically the structure of visor 4 that serves to lock helmet 2 in its folded, packed state. Visor 4 includes 10 flat links 64, 66, 68, 70 and 72 with each link rotatably connected to the next link; the rotation axis is defined as $r_2$, $r_3$, $r_4$, $r_5$ and $r_6$. Link 64 is hingeably connected to body 22 of the distal left and right struts 3, with rotation axis $r_1$.

FIG. 9*b* illustrates visor 4 covered by stretchable material 74. While the helmet is unfolded and splayed, the visor is opened and cover 74 stretches to accommodate the open visor shape. FIG. 9*c* is a side view of folded, packed helmet 2 with visor 4 in locked position. Link 64 is connected to part 61 of distal strut 33 by hinge 78.

Figure 10A:
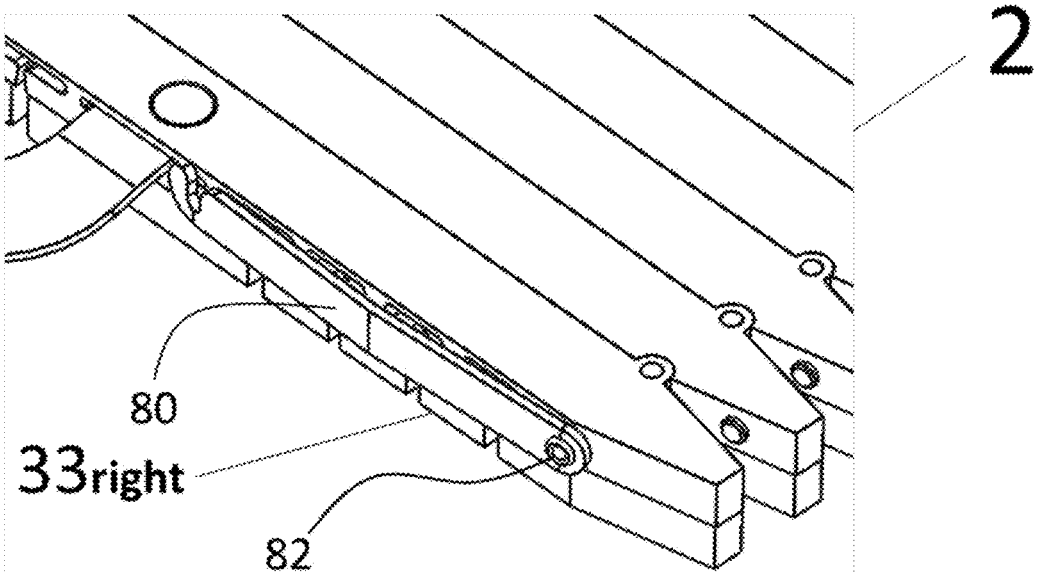
FIGS. 10*a-b* illustrate the safety open state locking mechanism of one embodiment of the present helmet.
Figure 10B:
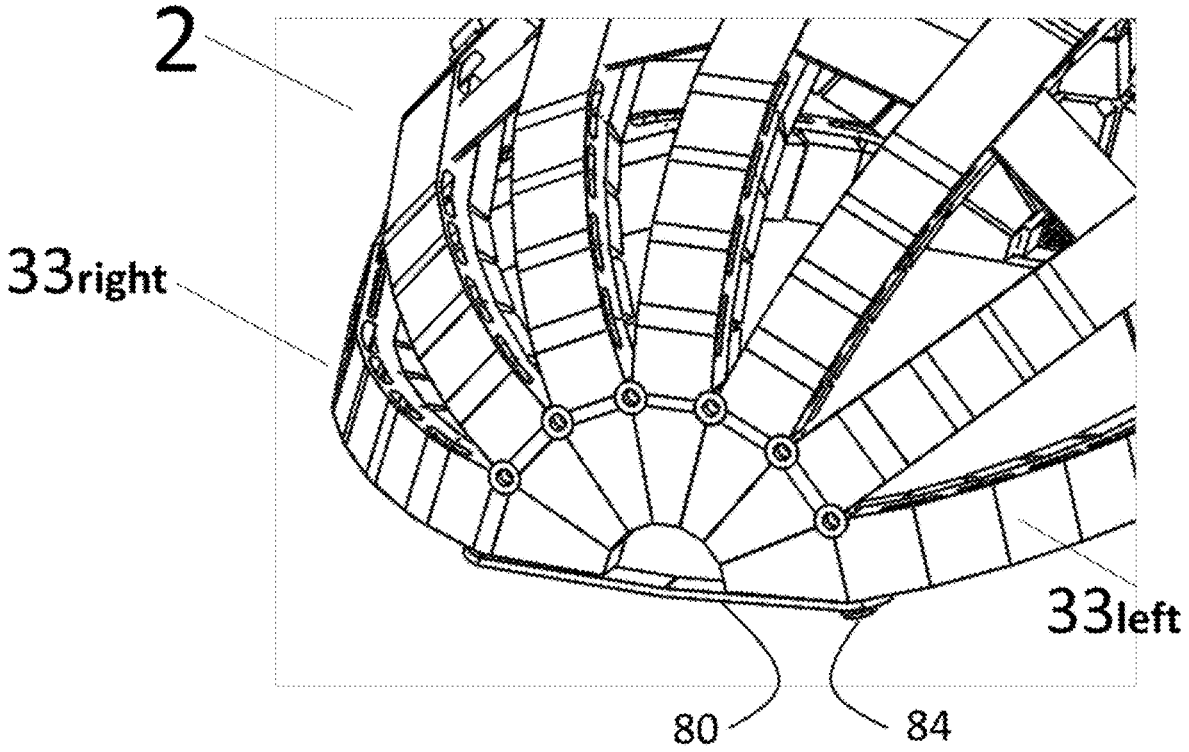

FIGS. 10*a*-*b* illustrate an additional locking mechanism for locking helmet 2 in the open state.

Locking lever 80 is positioned along the sides of struts 33 and is connected to strut $\mathbf{33}_{right}$ by ball joint 82, when helmet 2 is in the unfolded flat state (FIG. 10*a*). When in the dome state, locking lever 80 is locked over pin 84 located on the opposite strut $\mathbf{33}_{left}$ (FIG. 10*b*).

As used herein the term "about" refers to ±10%.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims. All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention.

What is claimed is:

1. A foldable helmet comprising a plurality of struts being hingedly interconnected thereby enabling said plurality of struts to splay out from a closed packed state, wherein each strut of said plurality of struts comprises:

(a) at least one additional hinge along a length of said strut for folding said strut;

(b) a plurality of cutouts in said strut allowing said strut to bow in a direction opposite a fold direction of said at least one additional hinge; and (c) on each side of at least one of said at least one additional hinge, a ratchet mechanism for adjusting a size of said strut.

2. The foldable helmet of claim 1, wherein splaying out said plurality of struts bows said plurality of struts.

3. The foldable helmet of claim 2, wherein splaying and bowing of said plurality of struts locks the helmet in a usable shape.

4. The foldable helmet of claim 1, wherein at least one end portion of at least one of said plurality of struts is prism-shaped or triangular-shaped.

5. The foldable helmet of claim 1, wherein at least one of a front end portion or a back end portion of said plurality of struts interlock when said plurality of struts are splayed open.

6. The foldable helmet of claim 1, wherein the helmet comprises a flat rectangle in said closed packed state.

7. The foldable helmet of claim 1, further comprising a strap system.

8. The foldable helmet of claim 7, wherein said strap system comprises two portions, each of said two portions being attached to a different struts of said plurality of struts.

9. The foldable helmet of claim 8, wherein pulling on said two portions of said strap system splays out said plurality of struts and opens the helmet.

10. The foldable helmet of claim 1, further comprising a foldable visor attached to front ends of said plurality of struts.

11. A method of donning a foldable helmet, comprising steps of:

(a) providing a foldable helmet comprising a plurality of struts being hingedly interconnected, said foldable helmet having at least two states, a closed packed state and an open state, each strut of said plurality of struts comprising:

i. at least one additional hinge along a length of said strut for folding said strut; and ii. a plurality of cutouts in said strut allowing said strut to bow in a direction opposite a fold direction of said at least one additional hinge; and iii. on each side of at least one of said at least one additional hinge, a ratchet mechanism for adjusting a size of said strut;

(b) unfolding said helmet by rotating distal portions of said plurality of struts relative to proximal portions of said plurality of struts about said hinged interconnections;

(c) placing said helmet on a head;

(d) pulling downward on a left outermost of said plurality of struts and on a right outermost of said plurality of struts; and (e) said helmet not fitting said head, adjusting a length of at least one strut by means of at least one of said ratchet mechanism;

thereby enabling said plurality of struts to splay out from said closed packed state to said open state.

12. The method of claim 11, additionally comprising a step of bowing said plurality of struts by splaying out said plurality of struts.

13. The method of claim 12, additionally comprising a step of locking the helmet in a usable shape by splaying and bowing of said plurality of struts.

14. The method of claim 11, additionally comprising a step of providing at least one end portions of at least one of said plurality of struts prism-shaped or triangular-shaped.

15. The method of claim 11, additionally comprising a step of interlocking at least one of a front end portion or a back end portion of said plurality of struts when said plurality of struts are splayed open.

16. The method of claim 11, additionally comprising a step of providing the helmet comprising a flat rectangle in said closed packed state.

17. The method of claim 11, further comprising providing a strap system.

18. The method of claim 17, additionally comprising a step of providing said strap system comprising two portions, each of said two portions being attached to a different struts of said plurality of struts.

19. The method of claim 18, additionally comprising a step of splaying out said plurality of struts and opening the helmet by pulling on said two portions of said strap system.

20. The method of claim 11, further comprising providing a foldable visor attached to front ends of said plurality of struts.

* * * * *